US006006952A

United States Patent [19]

Lucas

[11] Patent Number: 6,006,952

[45] Date of Patent: Dec. 28, 1999

[54] SPORTS BOTTLE

[76] Inventor: Monty J. Lucas, 3830 Village Ter. #241, Fremont, Calif. 94536

[21] Appl. No.: 09/019,150

[22] Filed: Feb. 6, 1998

[51] Int. Cl.[6] ..... B65D 37/00

[52] U.S. Cl. ..... 222/211; 222/212; 222/481.5; 222/522

[58] Field of Search ..... 222/481.5, 212, 222/211, 522

[56] References Cited

U.S. PATENT DOCUMENTS

| | | | |
|---|---|---|---|
| D. 249,228 | 9/1978 | Schacher et al. . | |
| D. 249,229 | 9/1978 | Schacher et al. . | |
| D. 249,329 | 9/1978 | Schacher et al. . | |
| 2,790,582 | 4/1957 | Halpern | 222/481.5 |
| 3,220,657 | 11/1965 | Nyden | 222/522 |
| 3,255,933 | 6/1966 | Martin | 222/212 |
| 3,411,674 | 11/1968 | Gould | 222/565 |
| 3,840,153 | 10/1974 | Devlin . | |
| 4,102,476 | 7/1978 | Loeffler . | |
| 4,147,306 | 4/1979 | Bennett . | |
| 4,184,603 | 1/1980 | Hamilton, Sr. . | |
| 4,516,697 | 5/1985 | Dreps et al. | 222/212 |
| 4,702,473 | 10/1987 | Paquette | 222/212 |
| 5,094,363 | 3/1992 | Monahan . | |
| 5,137,183 | 8/1992 | Mikulec et al. | 222/212 |
| 5,165,578 | 11/1992 | Laible . | |
| 5,169,035 | 12/1992 | Imbery, Jr. | 222/481.5 |
| 5,211,298 | 5/1993 | Bloch . | |
| 5,285,933 | 2/1994 | Gentes et al. | 222/212 |
| 5,295,597 | 3/1994 | Green . | |
| 5,667,101 | 9/1997 | Barrash et al. | 222/481.5 |

FOREIGN PATENT DOCUMENTS

| | | |
|---|---|---|
| 363172 | 10/1989 | European Pat. Off. . |

*Primary Examiner*—Lesley D. Morris
*Assistant Examiner*—Dinh Q. Nguyen
*Attorney, Agent, or Firm*—Richard C. Litman

[57] ABSTRACT

A sports bottle with contoured finger grooves for a better grip, a series of folds for preventing deformation of the bottle when squeezed by absorbing compressive forces, having a lid defining one-way air inflow orifices separate from a liquid outflow orifice, an integral straw member for directing liquids from within the bottle by either sucking or squeezing to the liquid outflow orifice, and a cap slidably attached to the straw member such that the liquid outflow orifice and the air inflow orifices are sealed when the cap is in the down position. The bottle allows the consumption of a liquid without tipping the bottle or interrupting consumption, and is adapted to open and close using only one hand.

10 Claims, 3 Drawing Sheets

SPORTS BOTTLE

BACKGROUND OF THE INVENTION

1. Field of the Invention

The present invention relates generally to liquid beverage containers or drinking devices and particularly to vented closures or nozzles equipped with a straw or drinking tube.

2. Description of Prior Art

Many simple devices for dispensing liquid from a container only contain one drinking tube ending in a single orifice. In such devices, the single orifice operates both as an outflow, where the liquid exits the container, and as an inflow, where air from the atmosphere surrounding the container enters. When a person draws a long drink of liquid from such single orifice, a negative pressure builds up inside the drinking tube created by the sucking action causing a differential pressure with the surrounding atmosphere. As air from the surrounding atmosphere tries to enter the container through the orifice to equalize the differential pressure, it impedes the outflow of the liquid. Also, during a lengthy draw, the negative pressure created in a tightly sealed container can become greater than the pressure able to be created by sucking, thus preventing liquid from rising in the drinking tube. These problems are solved by providing a separate air inflow orifice.

Unfortunately, simple air inflow orifices used in some liquid dispensing devices also permit outflow; thus, a simple design often results in spillage of liquid from inside the container discharged through the air inflow orifice. A one-way valve is thus desirable to solve such problem.

However, spill-limiting liquid dispensing devices often cannot be opened or closed without manipulation by both hands. This causes an inconvenience to those who want to drink a beverage, but need to use at least one hand elsewhere. A typical example of this problem includes drinking during bicycle riding. Since it is dangerous for a bicycle rider not to keep at least one hand on the handlebar while in motion, there is a need for a liquid dispensing device that can be opened, closed and used without requiring two free hands. One solution to this problem is to include a nozzle that moves up and down to open and close the liquid outflow orifice. This type of nozzle can be manipulated with the teeth instead of the hands.

However, such bottles for bike riders require the biker to tilt his head back in order to consume all of the contents of the bottle. Since it is unsafe for a biker to remove his eyes from the road, this design also presents a problem for bikers who want to quench their thirst while in motion. There is a need for a bottle from which the liquid contents can be fully consumed without tilting the head back.

Often, bottles for bike riders have a predominantly smooth, uniform surface. Bikers with palms or fingers moist from perspiration have difficulty gripping a predominantly smooth, uniform bottle surface. Also, when an unbroken bottle surface is squeezed, it tends to deform into the palm of the hand that is squeezing it. This deformation is uncomfortable to the person who is squeezing the bottle. Thus, there is a need for a bottle with a non-slip grip and for a bottle that does not deform into the palm of a hand that is squeezing it.

Exemplary of liquid dispensing devices having the above discussed disadvantages include the following. U.S. Pat. No. 5,295,597, issued to Richard D. Green on Mar. 22, 1994, and U.S. Pat. No. 5,211,298, issued to Harry S. Bloch on May 18, 1993, show bottles designed for use by infants. U.S. Pat. No. 5,094,363, issued to Timothy M. Monahan et al. on Mar. 10, 1992, and U.S. Pat. No. 3,840,153, issued to Edward J. Devlin on Oct. 8, 1974, show bottles designed for use by bicycle riders. Publications showing other specific uses include European Patent Number 363,172 (for saline solution), by Joseph Vincent Ranailetta et al., published on Apr. 11, 1990, and U.S. Pat. No. 4,147,306 (for foam) , issued to Robert S. Bennett on Apr. 3, 1979. Relevant U.S. Patents that are more general in application include U.S. Pat. No. 4,102,476, issued to Herbert H. Loeffler on Jul. 25, 1978, U.S. Pat. No. 4,184,603, issued to Calvin G. Hamilton, Sr., on Jan. 22, 1980, and U.S. Pat. No. 5,165,578, issued to Rodney Laible on Nov. 24, 1992.

U.S. Design Patents relevant to this invention include the following patents for bottles: Design Pat. No. 249,329, issued to Louis Schacher et al. on Sep. 12, 1978; Design Pat. No. 249,228, issued to Louis Schacher et al. on Sep. 5, 1978; and Design Pat. No. 249,229, issued to Louis Schacher et al. on Sep. 5, 1978.

None of the above inventions show a liquid dispensing device with a one-way air inflow valve separate from a liquid outflow orifice, which can be opened and closed without using both hands, and from which the contents can be fully consumed without inverting the device. Also, none of the above inventions show a bottle with a non-slip grip means and a means to prevent deformation into the palm of a hand while squeezing. Likewise, none of the above inventions and patents, taken either singularly or in combination, is seen to describe the instant invention as claimed. Thus a sports or bike bottle solving the aforementioned problems is desired.

SUMMARY OF THE INVENTION

The present invention is a sports or bike bottle with finger holds for gripping, a series of accordion folds for preventing deformation of the bottle when squeezed by absorbing compression forces, one-way air inflow orifices separate from a liquid outflow orifice, an integral straw member for directing liquids within the bottle to the outflow orifice by either sucking or squeezing, and a reciprocating cap slidably attached to the straw member such that the liquid outflow orifice and the air inflow orifices are sealed when the cap is in the down position. A consumer may completely drink a liquid from the bottle without tipping the bottle or interrupting consumption, and may open and close the bottle without the use of both hands.

Accordingly, it is a principal object of the invention to provide a spill-limiting drinking container with a uni-directional valve to enable air to enter while drinking liquid through a separate outflow port of the container.

It is another object of the invention to prevent liquid being undesirably discharged from the uni-directional valve of the sealed storage bottle.

It is a further object of the invention to provide a device with the ability to fully dispense all of the liquid in a container while that container remains in the upright position.

Another object of the invention is to provide a drinking container which limits a build-up of negative pressure within the container during drawing of liquid through the liquid outflow orifice.

Still another object of the invention is to provide a liquid dispensing device that can be opened, closed, and from which liquid can be consumed, without the use of two hands.

Further, it is an object of the invention to provide a liquid dispensing device that can be comfortably squeezed without the surface deforming into the users hand.

Another object of the invention is to provide a liquid dispensing device with a formed grip minimizing slipping of the hand and fingers.

It is an object of the invention to provide improved elements and arrangements thereof in a sports bottle for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
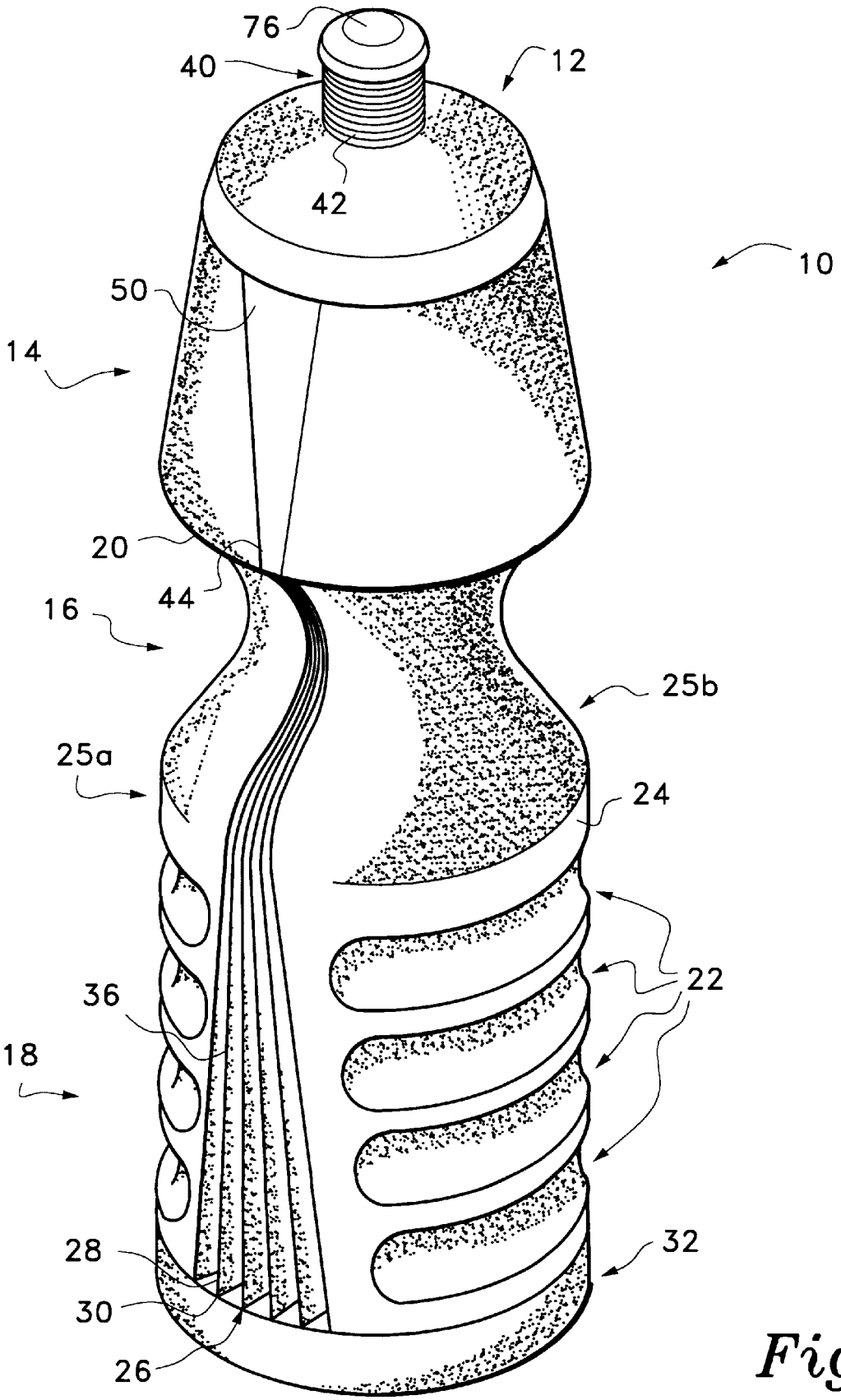
FIG. 1 is a perspective view of a sports bottle according to the present invention.

The present invention relates to liquid beverage containers and resealable nozzles or spouts. As generally shown in FIG. 1, the present invention is a bottle 10 having a liquid-tight lid 12 provided with a resealable nozzle or cap 40 for delivering a stream of fluid from the bottle. The bottle 10 has an upper portion 14, a middle portion 16, and a lower portion 18 which together form a container for retaining fluids. In the embodiment shown, the upper portion 14 is configured with a lower lip 20 where middle portion 16 unitarily joins with upper portion 2. Likewise, middle portion 16 is smoothly and unitarily joined with lower portion 18. Although middle portion 16 forms a constriction in the bottle in the preferred embodiment, any conventional sports bottle design may be adapted for use with the present inventive features as further described below.

Focusing first on the features of the lower portion, lower portion 18 of the bottle 10 is vertically bisected by a series of accordion folds 26, thus defining a first half 25*a* and a second half 25*b* of the lower portion 18. Each fold 36, comprising a trough 28 and a ridge 30, is made of a material having a resilient memory, such as many plastics, which in a conventional manner allows compression of the series of accordion folds. The folds 26 extend upwardly from above a base 32 toward the lid 12 through the lower portion 18 and the middle portion 16 ending at the lower lip 20 of the upper portion 14. At rest, the folds 26 are spaced apart, providing room to collapse in on each other. Thus when the bottle 10 is squeezed, the folds 26 become compressed together and deforming forces on the bottle 10 are absorbed so that uncomfortable outward deformation of the first half 25*a* and second half 25*b* into the hand is prevented. As noted, in order to achieve this advantage, the folds 26 must be constructed of a suitably resilient yet supportive material, such as one of the plastics that are well known today in the manufacture of squeezable sports bottles; however, the halves 25*a*, 25*b* should be slightly more rigid to transmit forces to the accordion folds 26, which may be accomplished by increasing the thickness of the material of the halves relative to the thickness of the material of the folds.

Moreover, the lower portion 18 is provided with a series of finger grooves 22, each of which extend circumferentially and generally parallel to one another around a substantial portion of the first half 25*a* and second half 25*b* of lower portion 18. Thus, two sets of finger grooves 22 on opposite sides of the lower portion 18 are formed. Each set of finger grooves 22 are recessed from the surface 24 of the lower portion 18 and dimensioned and positioned so that a normal sized adult hand can grip them securely. This provides a better grip on the bottle than a completely smooth lower portion 18 provides.

In the alternative, the grip of the bottle may also have finger holds (not shown) that protrude above the surface 24 of the lower portion 18 as convex annular rings. A convex shape is illustrated in the bite-ring 42 on the cap 40 above the lid 12 which analogously shows such annular rings. A fine pebbled texture may also be provided.

Turning now to the features of the upper portion 14, a channel 44 is shown recessed into the exterior surface of the upper portion 14, channel 44 extending from the top of the folds 26 to the lower edge 46 of the lid 12, forming a thumb notch 50 where it meets the lower edge 46 of the lid. The thumb notch 50 allows application of increased leverage to the lid 12 from below, with a consequential increased ease in removing a frictionally-held lid 12 (or "pop-off" lid) from the bottle 10. It should be apparent that the channel 44 need not extend directly from the ends of the folds 26, and that the folds 26 and the channel 44 are shown together merely for ease and clarity of discussion. The lid 12 covers a large mouth provided in the top of the upper portion 14 configured and dimensioned for receiving liquids and ice.

Figure 3:
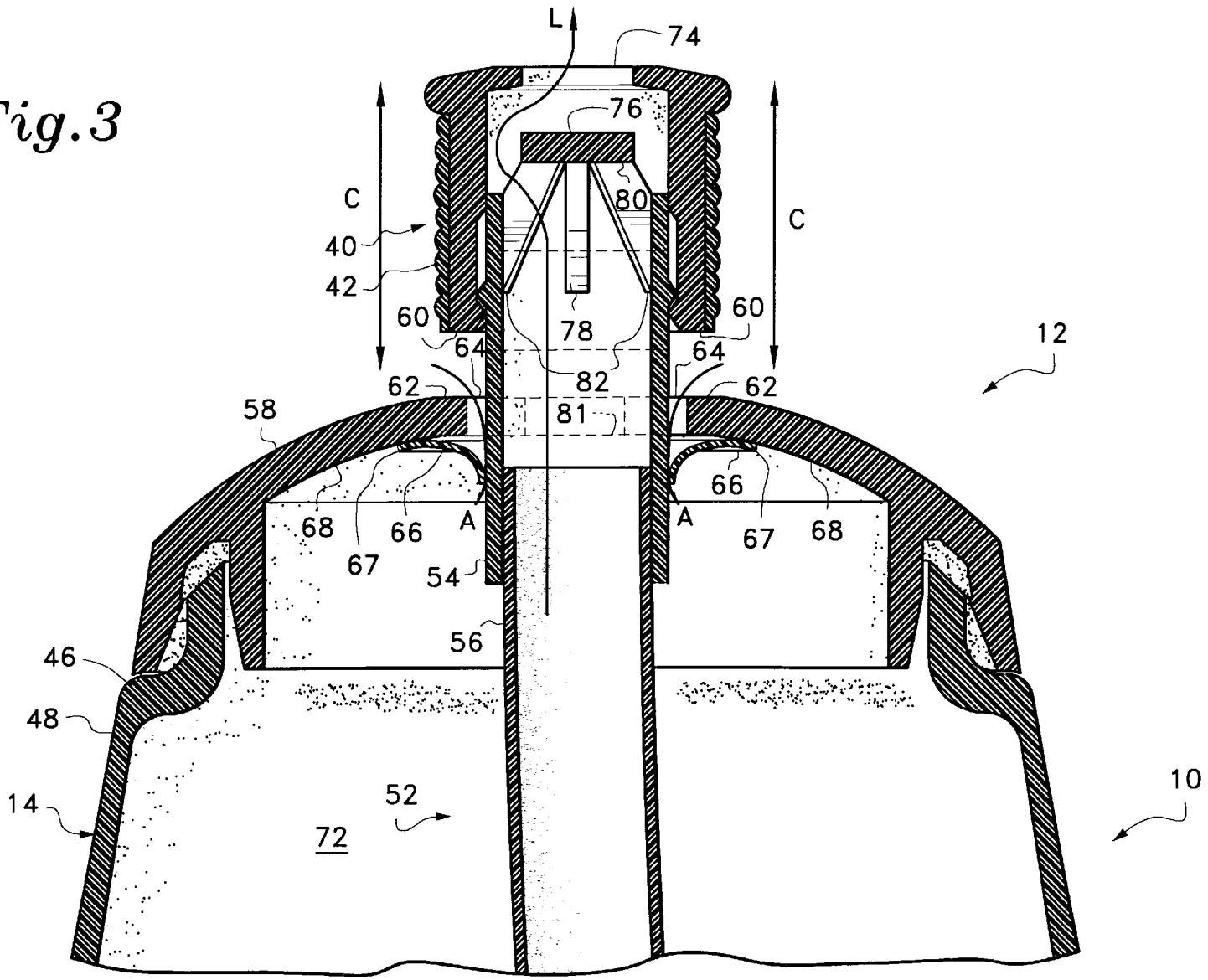
FIG. 3 is an enlarged, fragmented section view of a sports bottle according to the present invention.

FIG. 3 shows the critical and inventive features of the lid in section. The lid 12 comprises a cap 40 for resealably releasing a stream of fluid from the bottle; straw member 52 for directing the liquid from the base of the bottle to the lid; and a supporting member 58 for spanning and sealing the mouth of the upper portion 14. The support member 58 fastens to the upper portion 14 by a slip-on, pop-off connection in the pictured embodiment. Other embodiments can be envisioned wherein the support member 58 fastens to the bottle 10 by screw-on threads The straw member 52 includes two parts for ease of manufacture, a cylindrical upper part 54 connected to lid 12 and for supporting cap 40, and a tube 56 for drawing or directing fluids proximate to the base 32. The upper part 54 is dimensioned and configured to closely receive tube 56 and is sealed surrounding the tube 56. As suggested, the two parts of the straw member 52 may be made of one piece construction in other embodiments. The upper part 54 depends outwardly from the support member 58 to form a nozzle or spout, bridged by bridge member 81, necessary as will become later evident to define a plurality of air inflow orifices 64.

The cap 40 is slidably attached to the exterior of the upper part 54 so as to allow axial, reciprocal movement of the cap over the upper part 54, and is provided with a liquid outflow orifice 74. The cap 40 is surrounded radially by a bite-ring 42. The bite ring 42 is a bumpy or knurled textured surface on the exterior of the cap 40 so as to provide a better gripping surface for teeth. As shown in FIG. 1, annular rings may be formed on the surface of the cap 40 of the same material as the cap. In alternative embodiments, the bite-ring 42 may be made of a material having the characteristic of being softer than the material used for the bottle 10, lid 12, cap 40 or straw member 52. A softer material makes it more comfortable for a user to bite upon the bite-ring 42. The advantage of a bite-ring is that the cap 40 can be more comfortably and safely opened and closed without the use of two hands, by substituting the teeth for a hand.

In FIG. 3, the cap 40 is shown in the up, or open, position to allow liquid to be expelled through liquid outflow orifice 74 along liquid outflow path L. To seal such path, a plug 76 is supported in the top of the straw member 52 by a plurality of plug support members 78. The plug support members 78 are thin rigid strips set in the liquid flow path L and fixably attached to the bottom surface 80 of the plug 76 on one end and to the inside wall 82 of the straw member 76 on the other end. The number and material of plug support members 78 can be varied and should be sufficiently rigid to support the plug 76 against forces exerted to close the cap 40 and sufficiently discrete not to significantly impair the outflow of liquid. When the cap 40 is in the down position (not shown), a lower edge 60, defining a predetermined thickness of the wall of the cap 40, matingly contacts with support member 58 across surface 62.

To prevent undesired build-up of a vacuum within the bottle during drinking, the bottle 10 is provided with air inflow orifices 64 critically located relative to the cap 40 and lower edge 60. The support member 58 and bridging members 81 define air inflow orifices 64 proximate to upper part 54. The air flow orifices 64 are dimensioned and configured to have a maximum diameter less than the thickness of the wall of cap 40 as defined by lower edge 60. As can be appreciated from FIG. 3, when the cap 40 is in the closed position, the cap 40 simultaneously seals both the air inflow orifices 64, in addition to sealing the liquid outflow orifice 74 by plug 76 as described above, by forming an annular junction between lower edge 60 and surface 62.

To prevent inadvertent spillage of the fluid from the bottle through the orifices, a resilient washer or gasket 66 surrounds the straw member 52 and serves as a uni-directional valve, to prevent spillage of fluid through the orifices 64 and allow air to flow along path A from the exterior environment through the air inflow orifices 64 and in between the washer 66 and the straw member 52 to equalize any pressure differential between the bottle interior 72 and exterior. In order to properly seal the air inflow orifices 64 against the outflow of air or liquid from the bottle interior 72, the washer 66 must be a non-porous material and substantially impermeable to air and liquid. The washer must also be made of a material which is pliant to minimal forces and has a resilient memory. A suitable material having such qualities is a thin rubber sheet.

Figure 2:
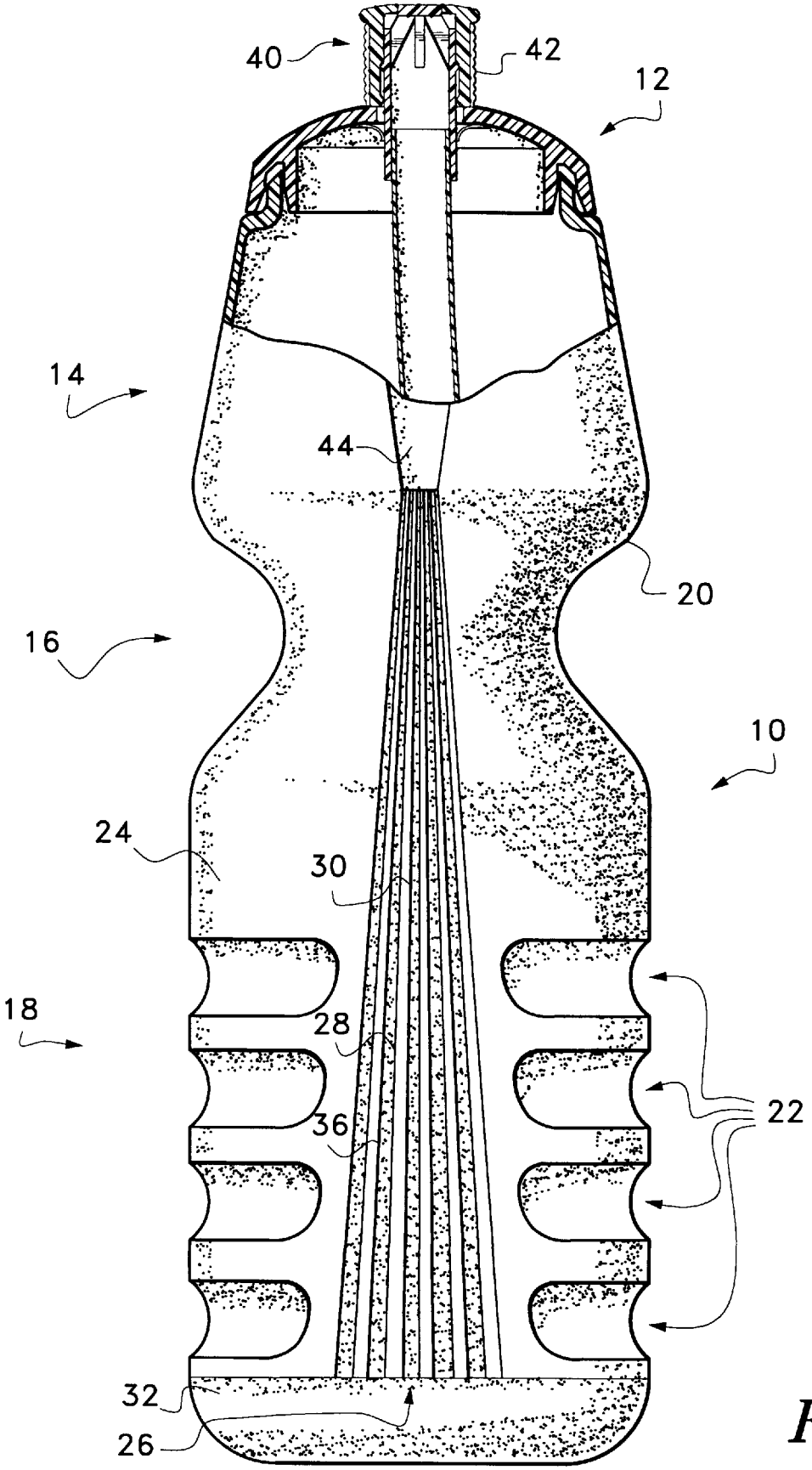
FIG. 2 is a partially fragmented and sectioned elevational view of a sports bottle according to the present invention.

The resilient washer 66 is annularly and fixably attached to the interior surface 68 of support member 58 and rests in contact with, but not attached to, the straw member 52. The peripheral edge 67 of the washer 66 must be attached to interior surface 68 beyond each air inflow orifice 64 with an air and water tight seal to prevent leakage around the periphery of the washer. As pictured in FIGS. 2 and 3, air and liquid from the bottle interior 72 cannot exit the bottle interior through the air inflow orifices 64 because the washer 66 remains collapsed and seals the air inflow orifices 64. The washer 66 is pictured concave relative to the bottle interior 72 and convex relative to the air inflow orifices 64, thus providing a bias against the wall of the upper part 54.

Thus, it can be readily observed that when the cap 40 is in the down position, the bottle 10 is air and water tight. However, when liquid is directly sucked into a one's mouth through the straw member 52 via the cap 40, air continually enters the bottle interior through the air inflow orifices 64 to equalize pressure by bending the pliant washer 66. Without this feature a consumer would be forced to drink in a discontinuous manner, allowing air pressure in the bottle interior 72 to equalize with the exterior environment each time the vacuum created by sucking became greater than the strength of the consumers sucking ability.

To further illustrate the invention's use, liquid from the bottle interior 72 can be forced up the straw member 52 by either exerting a manual compressive force on the lower portion 18, or by sucking by mouth on the cap 40. The liquid exits through the liquid outflow orifice 74 defined in the cap 40. The present functional design of the lid 12 with air inflow orifices 64 permits flow in one direction, while air pressure is maintained in the bottle interior 72 when the bottle 10 is squeezed. Thus, liquid in the bottle interior 72 is forced from the bottle interior into the straw member 52, from an opening in the bottom of the straw member 52, not shown. Another advantage of maintaining air pressure in the bottle interior 72 when the bottle is squeezed is that all of the contents of the bottle can be forced out of the liquid outflow orifice 74 without tilting the bottle 10 by both squeezing and sucking.

It is to be understood that the present invention is not limited to the embodiments described above, but encompasses any and all embodiments within the scope of the following claims.

I claim:

1. A sports bottle comprising:

a container body for receiving and storing liquids, having a mouth and a base;

a lid for removably sealing the mouth. having an interior surface and an exterior surface;

a resealable nozzle attached to the lid for permitting selective passage of fluids through the lid;

said lid defining an air inflow orifice independent of said nozzle;

said nozzle having a liquid outflow orifice and sealing means for selectively sealing and unsealing the liquid outflow orifice, the sealing means being positioned relative to the air inflow orifice such that reciprocal movement of the sealing means concurrently causes sealing and unsealing of the air inflow orifice;

a unidirectional valve for preventing fluid escape through the air inflow orifice from the container body, said unidirectional valve comprising a gasket made of a material having a resilient memory and being liquid and air impermeable, the gasket positioned over the air inflow orifice to selectively seal the air inflow orifice from the escape of a fluid contained by the container body, the gasket being fastened to the interior surface of the lid to form a fluid tight seal around the periphery of the gasket and biased against the nozzle to form a fluid tight seal when pressure is exerted against the gasket in an exterior direction;

water tight fastening means for securing the lid to the container body;

contoured gripping means integral to the container body; and, an accordion fold integral to the container body oriented along an upright axis of the container body from the base to the mouth.

2. The sports bottle as defined in claim 1 wherein the gripping means comprises a plurality of recesses contoured into the container body for receiving the fingers of a hand.

3. The sports bottle as defined in claim 1 further comprising a channel integral to the container body terminating proximate to the mouth for exposing a peripheral edge of the lid.

4. The sports bottle as defined in claim 1 wherein the nozzle comprises a tubular member including the liquid outflow orifice and a plug rigidly aligned and proximate to the liquid outflow orifice, and a cap defining a hole, the cap being reciprocally and slidably attached to the tubular member to define a fluid channel terminating with the hole and being in communication with the liquid outflow orifice, the hole concentrically aligned to mate with the plug, the central hole being filled by the plug in a down position and the liquid outflow orifice being unsealed when the cap is in an up position.

5. The sports bottle as defined in claim 1 wherein the nozzle further comprises a tube depending from the tubular member and extending within the container body to the base.

6. The sports bottle as defined in claim 1 wherein the nozzle has an exterior surface of uneven texture.

7. A sport bottle lid for use with a container body for receiving and storing liquids, having a mouth and a base, comprising:

a) A spanning member for removably sealing a mouth of a container body, the spanning member having an interior surface and an exterior surface, the spanning member defining an air flow orifice;

b) a resealable nozzle attached to the lid for permitting selective passage of fluids through the spanning member, wherein the nozzle has a liquid outflow orifice and sealing means for selectively sealing and unsealing the liquid outflow orifice, such that the reciprocal movement of the sealing means concurrently causes sealing and unsealing of the air inflow orifice;

c) a unidirectional valve for preventing fluid escape through the air inflow orifice from the container body, said unidirectional valve comprising a gasket made of a material having a resilient memory and being liquid and air impermeable, the gasket positioned over the air inflow orifice to selectively seal the air inflow orifice from the escape of a fluid contained by the container body, the gasket being fastened to the interior surface of the lid to form a fluid tight seal around the periphery of the gasket and biased against the nozzle to form a fluid tight seal when pressure is exerted against the gasket in an exterior direction; and d) substantially water tight fastening means for securing the lid to the container body.

8. The sports bottle lid as defined in claim 7 wherein the nozzle comprises a tubular member including the liquid outflow orifice and a plug rigidly aligned and proximate to the liquid outflow orifice, and a cap defining a hole, the cap being reciprocally and slidably attached to the tubular member to define a fluid channel terminating with the hole and being in communication with the liquid outflow orifice, the hole concentrically aligned to mate with the plug, the central hole being filled by the plug in a down position and the liquid outflow orifice being unsealed when the cap is in an up position.

9. The sports bottle lid as defined in claim 8 wherein the nozzle further comprises a tube depending from the tubular member and extending within the container body to the base.

10. The sports bottle as defined in claim 7 wherein the nozzle has an exterior surface of uneven texture.

* * * * *